US006409532B2

(12) United States Patent
Payson et al.

(10) Patent No.: US 6,409,532 B2
(45) Date of Patent: Jun. 25, 2002

(54) FIELD-ATTACHABLE IN-LINE SIGNAL CONNECTOR WITH PROTECTIVE MOLDED COVER

(75) Inventors: Brian D. Payson, Bolton, MA (US); Mark E. Fillion, Rumford, RI (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 09/802,177

(22) Filed: Mar. 8, 2001

Related U.S. Application Data

(60) Provisional application No. 60/188,966, filed on Mar. 10, 2000.

(51) Int. Cl.[7] ..... H01R 4/38
(52) U.S. Cl. ..... 439/320; 439/462
(58) Field of Search ..... 439/320, 676, 439/274, 275, 279, 462

(56) References Cited

U.S. PATENT DOCUMENTS 2,785,385 A * 3/1957 Figueira ..... 439/274
3,994,553 A * 11/1976 Kornick ..... 439/281
4,090,759 A * 5/1978 Hermann, Jr. ..... 439/281
4,932,882 A * 6/1990 Kang ..... 439/22
5,106,306 A * 4/1992 Ditzig ..... 439/26
5,803,770 A * 9/1998 Swendson et al. ..... 439/676

* cited by examiner

*Primary Examiner*—Tulsidas Patel
(74) *Attorney, Agent, or Firm*—Emrich & Dithmar

(57) ABSTRACT

A field-attachable structure for an in-line electrical connector which converts the connector for industrial applications includes a premolded connector body molded to the male portion of a compression seal. The premolded connector body receives a cable in a central opening and it receives the in-line connector, after field attachment to the cable, in a receptacle formed in the molded body. A clip locks the in-line connector to the connector body. A compression nut mates to the male portion to form a seal with the cable, and a coupling nut on the connector body is adapted to screw onto exterior threads of a mating connector.

7 Claims, 2 Drawing Sheets

FIELD-ATTACHABLE IN-LINE SIGNAL CONNECTOR WITH PROTECTIVE MOLDED COVER

PRIORITY DATE

This application claims the benefit of the filing date of copending U.S. Provisional Application No. 60/188,966, filed Mar. 10, 2000.

FIELD OF THE INVENTION

The present invention relates to electrical connectors; and more particularly, the invention relates to electrical connectors of the type used to connect conductive leads adapted to carry electrical signals, as distinguished from connectors designed to carry, for example, electrical power. Of particular interest are in-line electrical signal connectors of the type widely used to interface with the "EtherNet" communications network and the Universal Serial Bus (USB) connector, both of which are in widespread use in offices and other sites, but not in industrial applications such as manufacturing plants. These connectors are characterized as having a plurality (typically, eight) connector elements arranged side-by-side and parallel to one another or in a rectangular pattern for the USB connector. Hence, the connector elements are arranged in a line transverse of the direction of elongation of the associated conductor leads, and this type of connector is commonly referred to as an "in-line" connector.

BACKGROUND AND SUMMARY OF THE INVENTION

Conventional in-line signal connectors of the type described above and in connection with which the present invention is concerned, are not manufactured to meet the more rigorous conditions of use for industrial applications—that is, for use in factories and other manufacturing facilities. Typically, such in-line signal connectors are used in residential, office, or other commercial applications where they were not normally subjected to being twisted, stepped on and exposed to various fluids, as might typically occur in an industrial environment, such as an automated manufacturing facility. As the use of electronics and computer-centered control automation systems has entered the manufacturing environment, the use of communications networks has greatly expanded into the workplace as well. This has created a need for a more industrialized in-line signal connector for communications networks, capable of meeting the standard electrical specifications for existing in-line signal connectors, yet rugged enough to withstand the rigors of an industrial environment.

Another problem arises in connection with industrial grade electrical connectors used in customized communications networks, such as commonly occurs in factories. The problem is that the network cable and end connectors typically are not custom manufactured to a given length. Some installations prefer to route the master cable first and then cut it to size and attach the connectors after the cable has been cut. There are no commercially available, industrial quality EtherNet connectors for assembly to the cable on site (i.e., in the "field").

The present invention is illustrated in the context of a widely used and accepted multiple-lead connector assembly known as an RJ45 connector. RJ45 connectors are well known in the industry and have been used widely for connecting multiple-lead cable assemblies to equipment, specifically to printed circuit boards mounted within equipment cabinets. The invention however, is equally adaptable for use with USB connectors, and other electrical data connectors such as those referred to as "Firewire" connectors, as well as to connectors for optical cable.

The present invention provides a pre-molded connector body or cover molded to one half (the threaded portion in the illustrated embodiment) of a conventional compression seal for an electrical cable. The end of the molded connector body not attached to threaded portion of the cable compression seal provides a nesting region for the electrical connector, and a clip anchors the electrical connector to the molded connector body. A threaded coupling collet or nut is located on the molded connector body for securing the connector to a mating electrical panel mount connector.

With this combination, the master cable can be cut to length as desired. The female portion of the compression seal and the molded connector body (with a coupling nut) are then placed on the cable. Next the connector is crimped onto the cable, individual connections being made by insulation displacement techniques. The molded connector body, coupling nut and compression nut are positioned to seat the connector in the molded connector body, and a clip anchors the connector housing to the molded connector body. The compression nut is then tightened to seal against the cable.

There is thus provided a combination of elements which permit field installation of conventional electrical connectors and which add protection and mechanical stability for those connectors which renders them suitable for industrial use, even though the connectors themselves, without the added protection would not be suitable for industrial communication networks.

Other features and advantages of the present invention will be apparent to persons skilled in the art from the following detailed disclosure of the preferred embodiment accompanied by the attached drawing where identical reference numerals will refer to like parts in the various views.

DETAILED DESCRIPTION OF THE ILLUSTRATED EMBODIMENT

Figure 1:
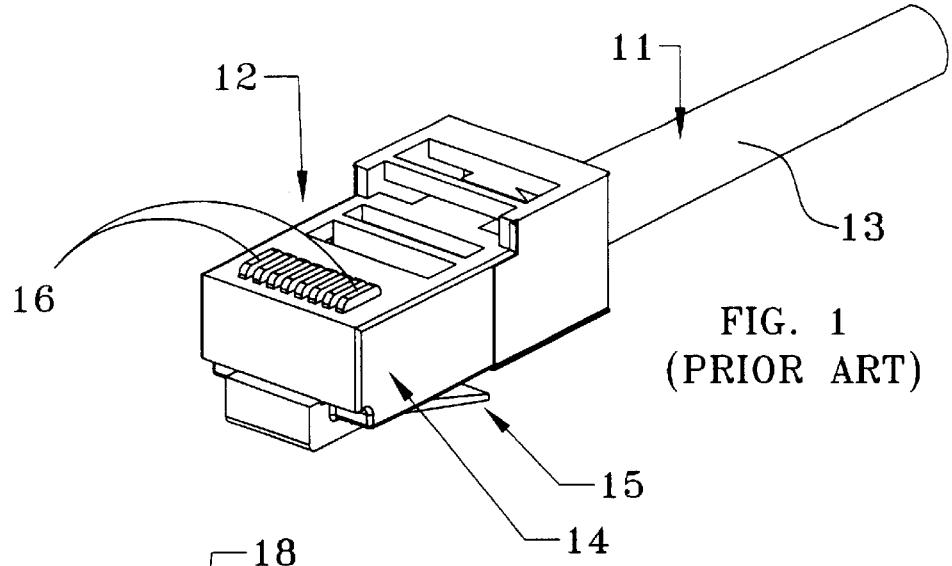
FIG. 1 (PRIOR ART)
FIG. 1 is a perspective view of a conventional in-line data connector connected to a conventional cable.

Turning first to FIG. 1, reference numeral 10 generally designates a prior art cable assembly including a cable 11 and a male in-line signal connector generally designated 12. As shown, the cable assembly is a standard assembly, available commercially in the form shown as a pre-assembled cord or as separate components for assembly on site. The cable 11 preferably may be a Category-5 or Category-5*e* cable or equivalent having a plurality of insulated leads (typically, eight leads) and is provided with an outer sheath 13 which may, depending upon the application, be polyurethane in order to provide increased resistance to oil and gas.

The male in-line connector includes a molded base 14 of standard construction and including a locking tab 15, for purposes to be later described. A plurality (again, eight) of male contact elements 16 are mounted in the base 14.

The eight contact elements 16 are identical in shape, in that they are mounted in side-by-side relation, electrically insulated from one another and spaced to form an in-line construction when viewed from the side. That is, the contact elements 16 are aligned, one behind the other when viewed along a plane perpendicular to the direction of extension of the cable 11. As used herein, "front" or "distal" refer to the connection end of the connectors and "rear" or "proximal" refer to the cable end.

The connector 12 is also commercially available individually. It meets the standards set by AT&ET for an RJ45 connector, and it is licensed by AT&T throughout the communications network industry, primarily for residential, personal, office and light commercial applications, such as data processing or inter-office communications usage.

The assembly of FIG. 1 is not suitable for use in industrial environments because the connection between the leads of the cable 11 and the contact elements 16 of the connector 12 cannot withstand the rigors of use in an industrial environment. In order to strengthen and protect the interface between the cable 11 and the connector 12, the present invention provides a molded connector body or cover generally designated by reference numeral 18. The molded connector body 18 is provided, at its rear end, with a two-piece compression seal generally designated 20. The compression seal is of a type generally known in the art and includes an externally threaded male portion 21 having a compressible, conical seal 35 received in a domed female compression nut 23. Both the male portion 21 and the female portion 23 of the compression seal 20 are received on the cable 11, as will be described. When the domed female portion 23 (which is internally threaded to provide a nut) is tightened onto the male portion 21 of the compression seal, it compresses the flexible sealing member of the male portion 21 which is received in the female portion 23 and engages and seals against the outer surface of the cable 11 under compression.

Turning now to the molded connector body or cover 18, it may be injection-molded of any number of suitable materials having sufficient strength to provide an adequate protection for the interface between the connector 12 and the cable 11. However, it may be of a polycarbonate ABS blend to provide a cushioning, but fairly hard substance. In molding the protective connector body or cover 18, the male portion 21 of the compression seal 20 is placed as an insert into the mold and the protective connector body 18 is then molded integrally with the male portion 21 to provide a suitable attachment of the body 18 to the male portion 21. This provides not only a seal, but mechanical stability as well.

Figure 3:
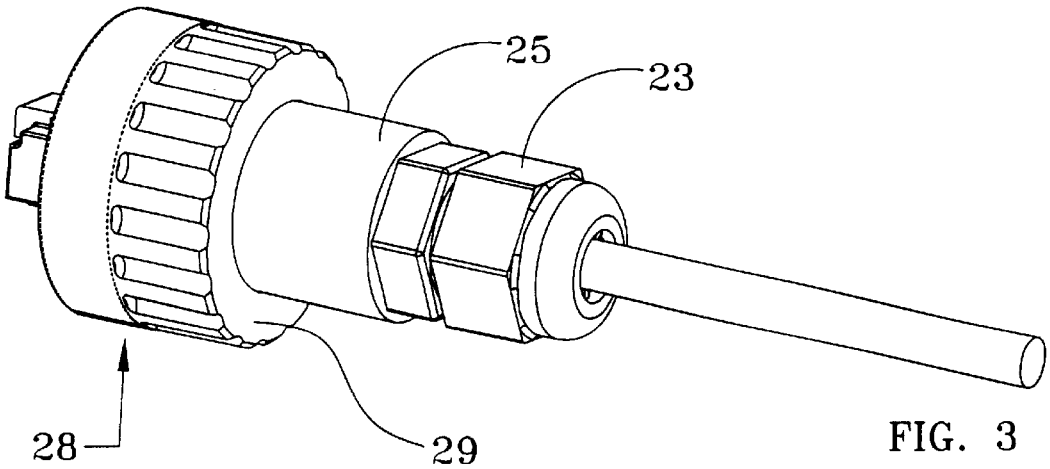
FIG. 3 is a view of the inventive connector assembly similar to FIG. 2 and including a coupling nut for assembly to a mating connector.

The protective connector body 18 includes a cylindrical sidewall 25 which has a cylindrical axial cavity sized to received the cable 11. At the forward end of the sidewall 25 is a radially, outwardly extending flange 26, the purpose of which is to restrain further forward movement of a coupling nut generally designated 28 in FIG. 3 and having a radial rear partial wall 29 defining a central opening sized to slide over the sidewall 25 of the molded protective body 18. The coupling nut 28 may be of conventional design having internal threads for coupling to a corresponding external thread on a mating female connector adapted to connect to the male connector 12.

Figure 2:
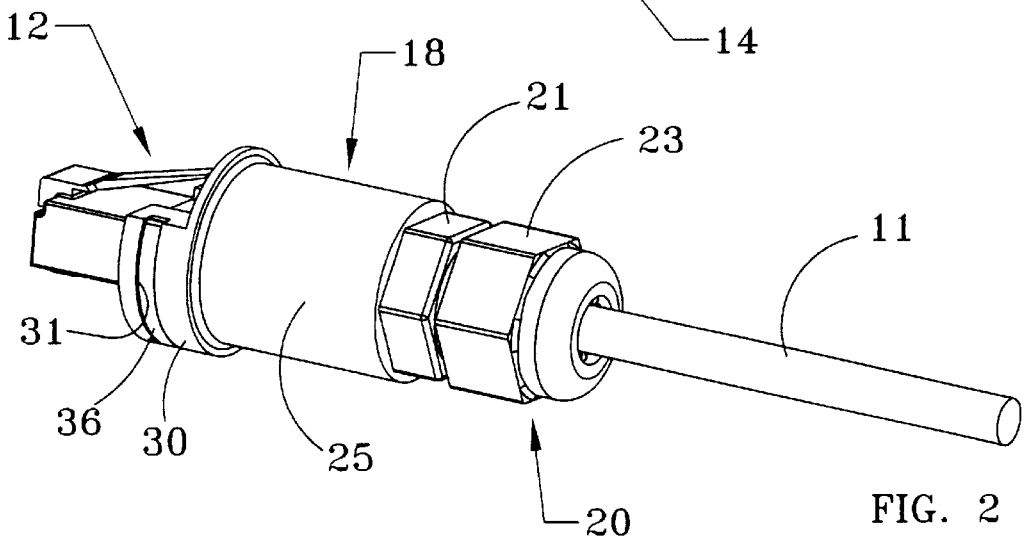
FIG. 2 is an upper rear perspective of an in-line connector provided with a protective connector body and compression seal according to the present invention.
Figure 4:
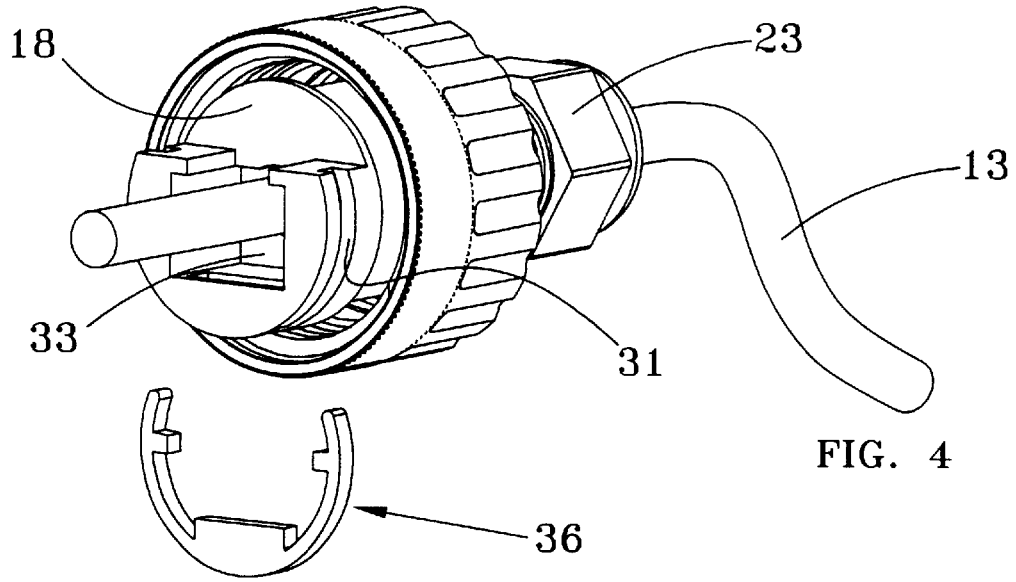
FIG. 4 is a frontal perspective view of a partial assembly of the inventive connector assembly illustrating assembly in the field.

Returning to FIG. 2, just forward of the flange 26, the molded protective body 18 includes a semi-circular portion 30 which is better seen in FIG. 4, and is provided with a radially inwardly extending slot 31. The forward portion 30 of the molded protective member 18 defines a rectangular cavity generally designated 33 and forming a receptacle for the rear end of the connector 12. The receptacle 33 is dimensioned such that, in combination with the material out of which the protective body 18 is molded, they form a tight slip fit with the rear end of the connector 12. By this, it is meant that the fit between the connector 12 and the receptacle 33 approaches that of a press fit, yet it falls short of a press fit, but does require more than a mere sliding force to assemble or disassemble, the connector.

Figure 5:
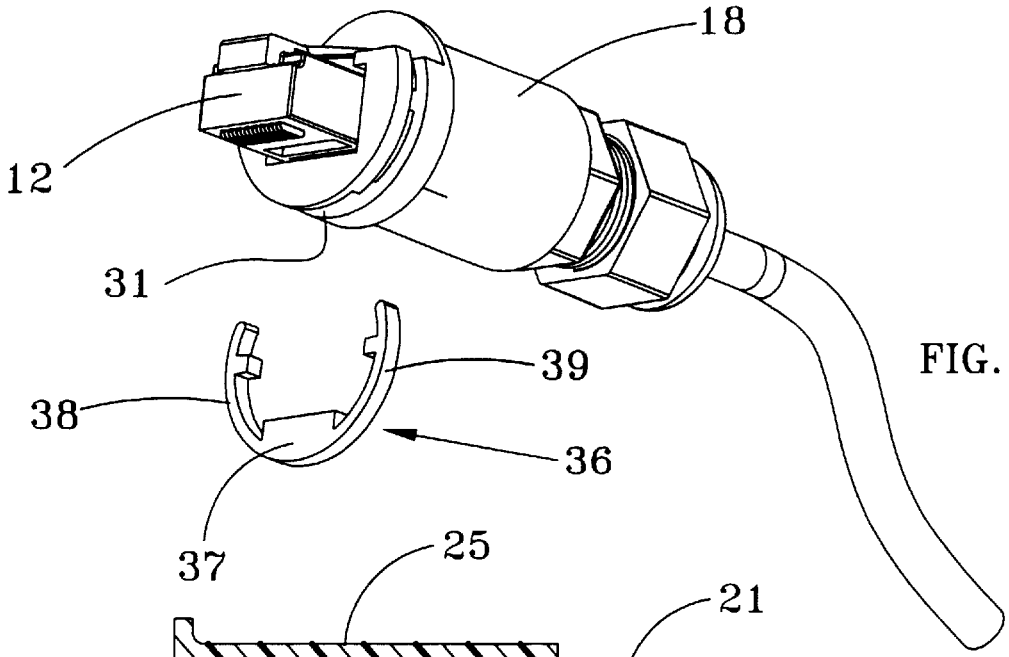
FIG. 5 is a lower frontal perspective view of the inventive connector assembly illustrating the use of a coupling clip to secure the molded connector body to the inline connector.
Figure 6:
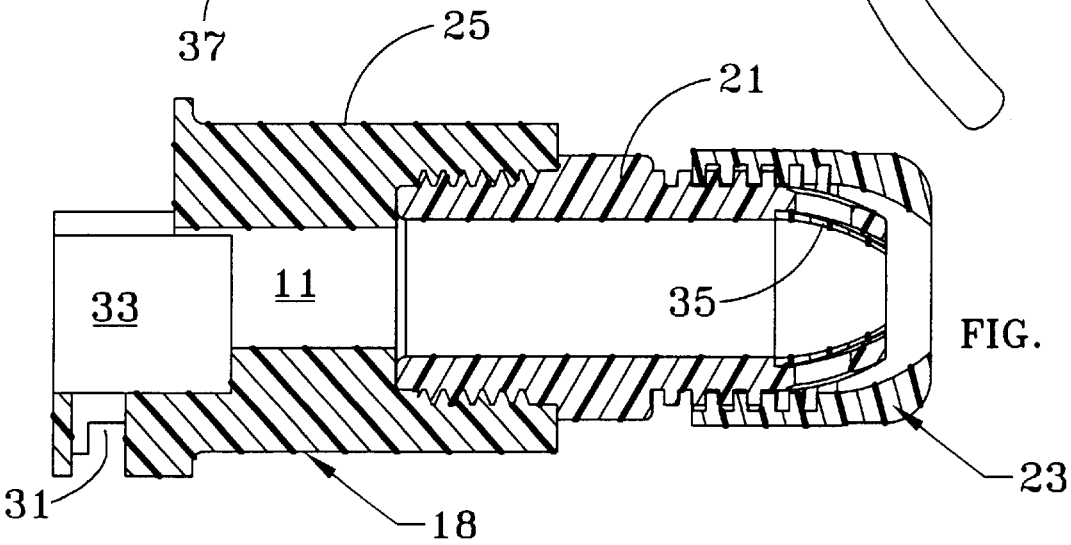
FIG. 6 is a longitudinal cross section view of the molded body, threaded male bushing, seal and compression nut in assembled relation.

Turning to FIG. 5, when the connector 12 is assembled to the molded protective body 18, the individual connector elements 16 project forwardly, as seen in FIG. 5 for connection to corresponding mating connector elements.

A clip, which is in the form of an E-clip in the illustrated embodiment and generally designated 36 in FIG. 5, is placed in the slot 31 formed in the extension 30 of the molded protective body 18 to couple the base 14 of the connector 12 to the protective molded body 18.

It will be observed that the E-clip 36 includes a central tab 37 and a pair of side flexible tines 38, 39. The tab 37 is received in a slot shown at 40 in FIG. 1 which prevents connector 12 from axial motion relative to the cylindrical protective body 18, and the tines 38, 39, which are provided with inwardly turned latch members, couple directly to corresponding recesses in the base 14 of the connector 12.

Field assembly of the connector 12 to the cable 13 will now be described. The cable 13 is cut to the desired length, and a connector 12 is provided separately of the cable 13. The domed compression nut 23 is placed on the cable 13 and then coupling nut 28 and molded protective body 18 are similarly slid on the cable 13. The cable 13 is then connected to the connector 12 using a conventional crimping apparatus which connects an associated lead from the cable 13 with each of the eight connector elements 16 of the connector 12.

Next, the E-clip 36 is snapped into the slot 31 to attach the connector 12 to the molded protective body 18, and the domed compression nut 23 is tightened under the male portion 21 of the compression seal 20. After the connector 12 is attached to a mating connector, the coupling nut 28 is available to form a mechanical coupling with the mating connector. Thus, field attachment of the connector 12 is conveniently provided with the present invention, and the final, assembled juncture between the cable 13 and the connector 12 is provided with a protective molded body or cover 18, the rear end of which is sealed to the cable 13.

While particular embodiments of the present invention have been shown and described, it will be apparent to those skilled in the art that changes and modifications may be made without departing from the invention in its broader aspects. The matter set forth in the foregoing description and accompanying drawings is offered by way of illustration only and not as a limitation.

We claim:

1. An apparatus for field conversion of an in-line connector and an associated cable to industrial applications, comprising:

a protective body including a compression seal, said body defining a central opening for receiving said cable and a receptacle for housing said connector;

a female compression nut adapted to be received on said male portion to form a seal with said cable;

a clip including a tab adapted to couple said connector to said protective body; and a coupling nut received on said protective body for threaded engagement with a male member of a mating connector.

2. The apparatus of claim 1 wherein said connector body is molded of a material to form a protective cover for the junction between said cable and said in-line connector.

3. The apparatus of claim 2 wherein said protective body defines a generally cylindrical sidewall and a peripheral flange extending about said sidewall, said flange retaining said coupling nut on said protective body, thereby to secure said connector to a mating connector when said coupling nut is coupled to said mating connector.

4. The apparatus of claim 1 wherein said protective body defines, adjacent said receptacle, a semi-circular portion having a radially inwardly extending slot, said clip comprising an E-clip including said tab, said tab extending into said slot of said semi-circular portion, the distal portion of said tab engaging said in-line connector to secure said body to said connector to inhibit axial motion of said protective body relative to said connector and cable.

5. The apparatus of claim 1 wherein the rear portion of said protective body defines a compression seal surrounding said cable when the protective body is assembled thereto, said compression nut compressing said rear portion of said connector body to form a compression seal about said cable.

6. The apparatus of claim 4 wherein said E-clip further includes flexible tines for engaging the exterior of said semi-circular portion of said protective body, thereby securing said in-line connector to said protective body.

7. The apparatus of claim 1 wherein said coupling nut defines internal threads for threadingly engaging corresponding exterior threads on a mating connector.

* * * * *